US011193237B2

(12) United States Patent
Nicholson

(10) Patent No.: US 11,193,237 B2
(45) Date of Patent: Dec. 7, 2021

(54) METHOD FOR ENHANCED OXYGEN DELIGNIFICATION OF CHEMICAL WOOD PULPS

(71) Applicant: SOLENIS TECHNOLOGIES, L.P., Wilmington, DE (US)

(72) Inventor: Daniel Joseph Nicholson, Wilmington, DE (US)

( * ) Notice: Subject to any disclaimer, the term of this patent is extended or adjusted under 35 U.S.C. 154(b) by 0 days.

(21) Appl. No.: 16/123,066

(22) Filed: Sep. 6, 2018

(65) Prior Publication Data

US 2019/0078258 A1 Mar. 14, 2019

Related U.S. Application Data

(60) Provisional application No. 62/556,706, filed on Sep. 11, 2017.

(51) Int. Cl.

| | |
|---|---|
| ***D21C 9/10*** | (2006.01) |
| ***D21C 9/00*** | (2006.01) |
| ***D21C 9/147*** | (2006.01) |
| ***D21C 3/02*** | (2006.01) |
| ***D21C 3/22*** | (2006.01) |

(52) U.S. Cl.

CPC ..... *D21C 9/1036* (2013.01); *D21C 3/02* (2013.01); *D21C 3/222* (2013.01); *D21C 9/005* (2013.01); *D21C 9/147* (2013.01)

(58) Field of Classification Search

CPC ..... D21C 9/1036; D21C 3/02; D21C 3/222; D21C 9/005; D21C 9/147

See application file for complete search history.

(56) References Cited

U.S. PATENT DOCUMENTS

| | | | | |
|---|---|---|---|---|
| 4,372,811 A | | 2/1983 | Samuelson et al. | |
| 4,406,735 A | | 9/1983 | Samuelson | |
| 4,439,271 A | * | 3/1984 | Samuelson | D21C 9/1005 162/19 |
| 4,963,157 A | | 10/1990 | Machida et al. | |
| 5,698,075 A | * | 12/1997 | Troughton | D21C 9/1057 162/65 |
| 5,859,286 A | * | 1/1999 | Yamaguchi | C07C 69/675 560/205 |
| 6,221,206 B1 | | 4/2001 | Bokstrom et al. | |

(Continued)

FOREIGN PATENT DOCUMENTS

| | | |
|---|---|---|
| CA | 1120210 A | 3/1982 |
| EP | 1061173 A1 | 12/2000 |

(Continued)

OTHER PUBLICATIONS

Hart et al, The effect of digester kappa number on the bleachability and yield of EMCC softwood pulp, Apr. 2006, Tappi Journal (Year: 2006).*

(Continued)

*Primary Examiner* — Eric Hug
*Assistant Examiner* — Elisa H Vera
(74) *Attorney, Agent, or Firm* — Lorenz & Kopf, LLP

(57) ABSTRACT

A method for producing a high yield Kraft pulp is provided. In particular, the method involves adding a composition comprising an organic amine phosphonate and a sulphonated linear alcohol ethoxylate surfactant to a pulping process. The composition enhances the delignification of cellulosic fiber in chemical wood pulps.

14 Claims, 4 Drawing Sheets

(56) References Cited

U.S. PATENT DOCUMENTS

| | | | | |
|---|---|---|---|---|
| 6,454,900 | B2 | 9/2002 | Bokstroem et al. | |
| 6,569,286 | B1 | 5/2003 | Withenshaw et al. | |
| 6,770,168 | B1 * | 8/2004 | Stigsson | D21C 1/06 162/24 |
| 2003/0019596 | A1 * | 1/2003 | Ragauskas | D21C 9/1036 162/72 |
| 2003/0085008 | A1 | 5/2003 | Duggirala et al. | |
| 2005/0217813 | A1 | 10/2005 | Schevchenko et al. | |
| 2007/0272378 | A1 | 11/2007 | Paren et al. | |
| 2010/0236734 | A1 | 9/2010 | Giles et al. | |
| 2011/0111456 | A1 * | 5/2011 | Medoff | C13K 1/02 435/68.1 |
| 2012/0160438 | A1 * | 6/2012 | Verrett | D21C 3/226 162/175 |
| 2014/0371442 | A1 * | 12/2014 | Nonni | D01F 2/00 536/56 |

FOREIGN PATENT DOCUMENTS

| | | | |
|---|---|---|---|
| JP | 2000080582 | A | 3/2000 |
| WO | 00/47812 | A1 | 8/2000 |
| WO | 2014/122533 | A2 | 8/2014 |
| WO | 2014/140852 | A2 | 9/2014 |

OTHER PUBLICATIONS

Widiatmoko, "Oxygen Delignification Process Chemistry for ACACIA", A Thesis Presented to The Academic Faculty, Georgia Institute of Technology, Dec. 2006, pp. 1-144.

McDonough, Thomas J., "Oxygen Delignification", Pulp Bleaching. Principles and Practices, Dence & Reeve Eds. 1996, Chapter IV-1.

Hazmeh, Y., et al. "Soda Pulping With Surfactants", BioResources, 2009, pp. 1267-1275, vol. 4, No. 4.

ISA/US, International Search Report and Written Opinion issued in International Application No. PCT/US18/49642, dated Jan. 29, 2019.

Hamalainen, H. et al. "Silicate-Free Peroxide Bleaching of Mechanical Pulps: Efficiency of Polymeric Stabilizers", International Mechanical Pulping Conference, 2007.

Felissia, F.E., et al. "Chelating Agents in Eucalyptus Kraft Pulps", Congreso Iberoamericano de Investigacion en Cellulosa y Papel, 2002.

* cited by examiner

METHOD FOR ENHANCED OXYGEN DELIGNIFICATION OF CHEMICAL WOOD PULPS

CROSS-REFERENCE TO RELATED APPLICATION

This application claims priority to U.S. Provisional Patent Application No. 62/556,706, filed on Sep. 11, 2017, the entire contents of which are hereby incorporated by reference.

BACKGROUND

The invention relates to a composition that enhances the delignification of cellulosic fiber in chemical wood pulps. In particular the composition can be added after chemical pulping and washing of the wood pulps.

The pulps may be prepared from any wood species, hardwoods or softwoods, as well as agricultural biomass including but not limited to bamboo, sugar cane bagasse, grain straw, and annual grasses. The pulping process to convert wood chips into chemical pulp include the Kraft process, neutral and acid sulfite pulping, soda pulping (with and without additional catalysts such as anthraquinone), and solvent pulping.

Chemical wood pulps are generally delignified using pressurized oxygen (oxygen delignification) to reduce the lignin content by 40-70%. Delignification is typically done in advance of multiple stage bleaching. Wood pulp typically used in this process is produced from softwoods containing a lignin content of 3-7%, and from hardwoods containing 2-4% lignin. These pulps are typically manufactured by a Kraft process using known methods, such that when the Kraft cook is terminated earlier (or after milder cooking) the result is a larger amount of pulp (higher yield) with a higher lignin content.

The current method of enhancing the delignification of wood pulp relates to pulp that is treated with a composition in a 2-stage oxygen delignification process. Delignification of a high kappa number pulp generally needs to have more aggressive or harsh conditions to obtain the lower desired kappa number pulp. By aggressive conditions, we mean that the process conditions to lower the kappa number require higher temperature, higher alkalinity, longer time, or various combinations of these factors, in order to reduce the lignin content by 40-70%. As a result of these harsh or aggressive conditions, there can be a higher loss of cellulose than under less harsh conditions. However, these conditions can also result in lower pulp quality as defined by solution viscosity (TAPPI T230 om-13). The oxygen delignification stages in the treatment of chemical pulp reduce the residual pulp lignin to a limited extent, but at the same time oxidatively cleave the cellulose chains (depolymerization) and decrease physical properties of the pulp. This is the limiting factor to its more effective utilization. If the oxygen delignification process could be improved or enhanced, even more lignin could be removed, but in current practice this results in unacceptable weakening of the fiber product as measured by pulp viscosity and fiber tensile strength TAPPI T231 cm-07.

The fundamental chemical reactions, industrial application of the process, and the limitations just described are reviewed in; McDonough, Thomas J., Oxygen Delignification, Chapter IV-1 in; Pulp Bleaching. Principles and Practices, Dence & Reeve Eds. 1996. The focus for controlling pulp quality has historically been on optimizing the reaction parameters to minimize cellulose depolymerization. Very little description is given to beneficial chemical additives, beyond the initial discovery of magnesium salts as cellulose protectants. A recent thesis on "Oxygen Delignification Process Chemistry for ACACIA", described the delignification process in the production of bleached Kraft pulp in detail, Widiatmoko, Georgia Institute of Technology, December 2006. However, magnesium additives are mentioned only to say that one of the most significant factors to enhance oxygen delignification is the effective mixing of the chemicals with corresponding pulp. There is no teaching that the chemical additives currently being taught would have any impact on reducing the kappa number of Kraft pulp.

U.S. Pat. No. 6,454,900 B2, discloses a two-stage oxygen delignification process for lowering the kappa number of medium consistency pulp in which temperature, pressure and alkalinity of the system are optimized. However, there is no mention of specific chemical additives that would enhance the oxygen delignification process.

In current practices, chemical additives are used during the oxygen delignification process to inhibit cellulose depolymerization and protect the pulp strength. Magnesium salts are the most commonly used (often applied as Epsom salt, $MgSO_4 \cdot 7H_2O$), but additional organic complexing agents or chelants have also been found to protect the cellulose.

Canadian patent 1 120 210 (Monsanto), discloses the addition of aminomethylene phosphonate chelants in combination with magnesium salt, which was found to be effective when the phosphonate was added in quantities greater than 0.1% on the dry weight of the pulp (hereafter described as oven dry weight, OD). The patent discloses adding a diethylenetriamine pentamethylene phosphonic acid (DTPMP), to a pH neutral solution in which the DTPMP is typically substituted with about 7 sodium cations (DTPMP·7Na). However, there is no disclosure of additional materials like surfactants or polymers that might enhance performance of the delignification and cellulose protection.

US 2007/0272378 A1, discloses a method for reducing extractives in peroxide bleaching of mechanical pulp by adding an anionic surfactant and polymeric peroxide stabilizers, which inhibits precipitation of the extractives onto pulp fibers by keeping the extractives in the water phase. However, there is no disclosure or teaching of use with chemical pulps or with an oxygen delignification process used on chemical pulp, to protect cellulose and enhance delignification, which is not part of a peroxide bleaching process.

JP2000/080582 (Mitsubishi), teaches that the kappa number of a medium-consistency chemical pulp can be reduced in oxygen bleaching by adding a phosphonate chelant alone or in combination with a surfactant to the pulp. An alternative two stage process is described in which one stage can be acidic and the other alkaline. No disclosure is made related to the addition of magnesium sulfate to protect cellulose viscosity.

In other oxygen bleaching processes, U.S. Pat. Nos. 4,406,735 and 4,439,271 describe a pretreatment of the pulp with nitrogen dioxide prior to the delignification of cellulose pulp in one or two stages of alkaline oxygen bleaching. U.S. Pat. No. 4,372,811, teaches an alkaline oxygen delignification and bleaching of chemical cellulose pulp while inhibiting degradation of carbohydrates in the pulp, by adding one or more aromatic diamines in addition to magnesium and a chelant that includes aminomethylene phosphonic acids such as, diethylenetriamine pentamethylene phosphonic acid (DTPMP). No disclosure is made related to the addition of materials such as surfactants or polymers to enhance delignification and protect cellulose viscosity.

A published study showed that application of surfactants during the soda pulping of bagasse decreased kappa number and improved the yield and brightness of the resulting pulp. However, the study was restricted to bleaching experiments and the bleaching process (BioResources, 4(4), 1267-1275, 2009, "Soda Pulping with Surfactants", Hamzeh et al. US 2005/0217813 A1, discloses that diethylenetriamine pentamethylene phosphonic acid (DTPMP) can maintain or increase the brightness level of a pulp while decreasing the levels of bleaching chemicals, but makes no mention of oxygen delignification.

Chemical pulp that is delignified by oxygen suffers from cellulose degradation that is higher if the pulp is treated in a 1-stage system as compared with treatment in a 2-stage system when delignified to the same final kappa number (as determined by TAPPI T 236 om-13), which is an indication of the residual lignin content or bleachability. The 2-stage system allows the pulp to be reacted first at higher pH, higher oxygen pressure, and lower temperature for a shorter time period than a 1-stage system, after which the pulp may be treated in a second stage at lower pressure, lower pH, and higher temperature for a longer time. The process of a 2-stage oxygen delignification is disclosed in U.S. Pat. No. 6,454,900 (Sunds 2002). The process relates to two separate oxygen treatments at two different conditions.

The current methods provide for enhancement of the oxygen delignification process wherein lower phosphonate levels are realized and, in some embodiments, see a complete removal of magnesium salts. There is also a need for improved environmental performance of pulp mills by reducing the amounts of phosphorus and nitrogen containing chemicals used in pulping and bleaching operations. In addition, there is a clear need for improvements to the oxygen delignification process that will result in a reduced lignin content, increased strength of the fiber produced, and higher fiber yield. The current formulations have been found to accomplish all of the benefits listed above.

SUMMARY

The current method relates to producing a high yield Kraft pulp. In particular, the method involves adding a composition comprising an organic amine phosphonate and a sulphonated linear alcohol ethoxylate surfactant, in particular sodium lauryl ether sulfate (SLES). The composition can optionally contain a source of magnesium as a divalent cation ($Mg^{2+}$) from a magnesium salt, such as, magnesium sulfate ($MgSO_4$), magnesium sulfate heptahydrate ($MgSO_4 \cdot 7H_2O$), magnesium oxide (MgO), magnesium hydroxide ($Mg(OH)_2$), magnesium acetate ($Mg(CH_3COO)_2$), magnesium acetate tetrahydrate ($Mg(CH_3COO)_2 \cdot 4H_2O$) and magnesium carbonate ($MgCO_3$).

In another aspect, a method of producing a high yield oxygen delignified Kraft pulp is provided wherein the Kraft pulp having a kappa number of at least about 30 and can be at least about 23 and may be at least about 20 for hardwood pulp; or kappa numbers of at least about 40 and can be at least about 33 and may be at least about 30 for softwood pulps. The Kraft pulp is treated with a composition comprising: a) an organic amine phosphonate in an amount of from about 0.6 kilogram per metric ton dry weight pulp (kg/MT) to about 1.2 kg/MT on active acid basis; b) magnesium salt in an amount of from about 0.1 kg/MT to about 3.2 kg/MT anhydrous basis; and c) from about 0.08 kg/MT to about 0.16 kg/MT on an active basis of a surfactant selected from the group consisting of sulfonated linear alcohol ethoxylates. The Kraft pulp is treated with the composition prior to an oxygen delignification process. In the context of the present invention the phrase "active acid" or "active solids" or "actives" means the weight of each chemical in the composition applied to the pulp.

In another aspect of the current method, the composition added to the Kraft wood pulp includes an organic amine phosphonate and an anionic polyacrylate, in particular a poly-alpha-hydroxyacrylate salt (PHAS).

In yet other aspects of the current method, the organic amine phosphonate can be a diethylenetriamine pentamethylene phosphonic acid (DTPMP), aminotrismethylene phosphonate (ATMP), (bis)hexamethylenetriamine pentamethylene phosphonic acid (BHMTPMP), and polyamino polyether methylenephosphonate (PAPEMP) and the anionic polyacrylate is a poly-alpha-hydroxyacrylate salt (PHAS).

In other aspects of the method, the temperature of the first stage of a 2-stage oxygen delignification process is from about 80 degrees Celsius (° C.) to about 100° C. and the temperature of the second stage is from about 90° C. to about 120° C.; and the pressure of the first stage is from about 80 pounds per square inch (psi) to about 120 psi $O_2$, can be 90 psi to 110 psi $O_2$ and the pressure of the second stage is from about 25 psi to about 90 psi, can be from about 50 psi to about 90 psi $O_2$, can be 60 psi to 90 psi $O_2$.

In yet other aspects of the method, there is provided a Kraft pulp having a kappa number of at least about 30 and can be at least about 23 and may be at least about 20 for hardwood pulps, or kappa numbers of at least about 40, can be at least about 33, and may be at least about 30 for softwood pulps; and treating the Kraft pulp with a composition comprising: a) an organic amine phosphonate in an amount of from about 0.17 kg/MT to about 0.57 g/MT on active acid basis; b) magnesium salt in an amount of from about 0 kg/MT to about 3.2 kg/MT anhydrous basis; and c) from about 0.43 kg/MT to about 1.43 kg/MT on an active basis of an anionic polyacrylate, such as a poly-alpha-hydroxyacrylate salt (PHAS); and wherein the Kraft pulp is treated with the composition prior to an oxygen delignification process.

According to the current method, the Kraft pulp is treated with the composition prior to an oxygen delignification process.

DETAILED DESCRIPTION

Figure 1:
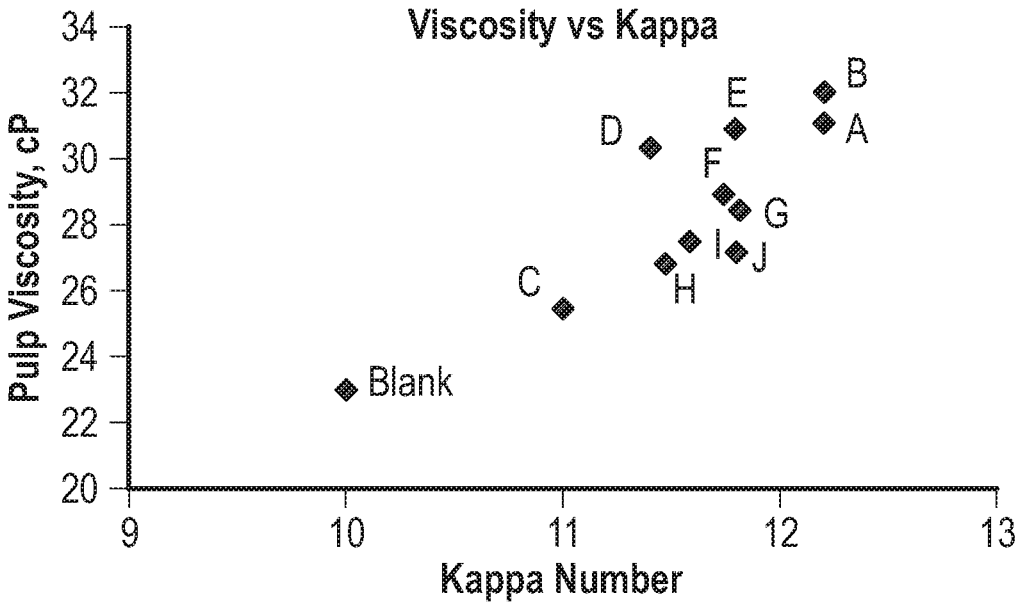
FIG. 1, illustrates a preferred lignin removal/kappa reduction is toward the left, and a preferred higher viscosity protection is toward the top.

The following detailed description is merely exemplary in nature and is not intended to limit the invention or the application and uses of the invention. Furthermore, there is no intention to be bound by any theory presented in the preceding background of the invention or the following detailed description.

In one aspect the current method relates producing a high yield Kraft pulp comprising: providing a Kraft pulp having a kappa number of at least about 30 and can be at least about 23 and may be at least about 20 for hardwood pulp or kappa numbers of at least about 40 and can be at least about 33 and may be at least about 30 for softwood pulps; treating the Kraft pulp with a composition comprising: a) an organic amine phosphonate; b) a magnesium salt; and c) one or more sulfonated ethoxylates; wherein the Kraft pulp is treated with the composition prior to an oxygen delignification process. In particular, the one or more sulfonated ethoxylate is sodium lauryl ether sulfonate (SLES), sodium lauryl ether phosphate (SLEP), or sodium lauryl sulfate (SLS). See Formula I-III below.

Formula I

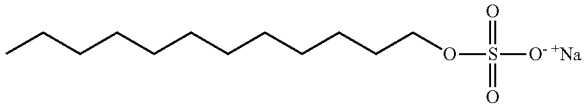

Sodium lauryl sulfate (SLS)

Formula II

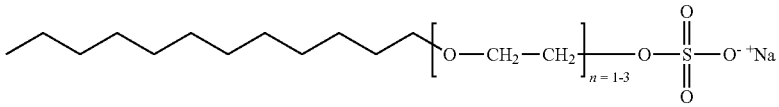

Sodium lauryl ether sulfate (SLES)

Formula III

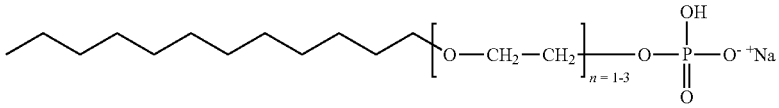

Sodium lauryl ether phosphate (SLEP)

In another aspect, the organic amine phosphonate of the composition is selected from diethylenetriamine pentamethylene phosphonic acid (DTPMP), aminotrismethylene phosphonate (ATMP), (bis)hexamethylenetriamine pentamethylene phosphonic acid (BHMTPMP), and polyamino polyether methylenephosphonate (PAPEMP) and the magnesium divalent cation $Mg^{2+}$is from a magnesium salt such as magnesium sulfate, or magnesium sulfate heptahydrate. See Formula's IV-VII below.

Formula IV

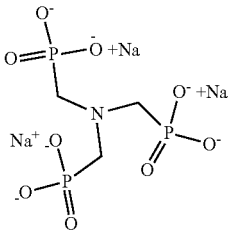

Aminotrismethylene phosphonate (ATMP)

Formula V

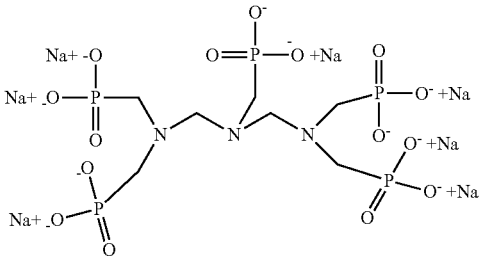

Diethylenetriamine pentamethylene phosphonate (DTPMP)

-continued

Formula VI

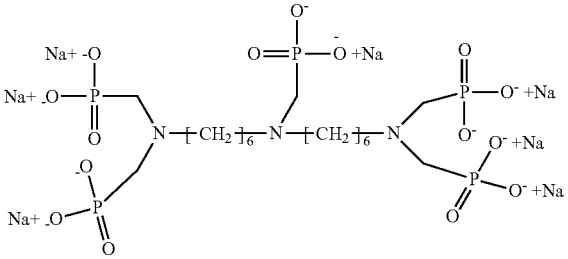

(Bis)hexamethylenetriamine pentamethylene phosphonic acid (BHMTPMP)

Formula VII

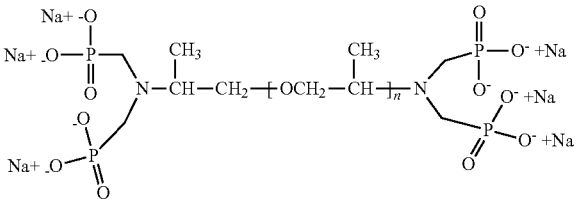

Polyamino Polyether Methylenephosphonate (PAPEMP)

In yet another aspect, the oxygen delignification process is a 1 or 2-stage oxygen delignification process, wherein method of producing a high yield oxygen delignified Kraft pulp comprising: providing a Kraft pulp having a kappa number of at least about 30 and can be at least about 23 and may be at least about 20 for hardwood pulps, or kappa numbers of at least about 40, can be at least about 33, and may be at least about 30 for softwood pulps; treating the Kraft pulp with a composition comprising: a) an organic amine phosphonate in an amount of from about 0.6 kg/MT to about 1.2 kg/MT on active acid basis; b) magnesium salt in an amount of from about 0.1 kg/MT to about 3.2 kg/MT anhydrous basis; and c) a surfactant in an amount of from about 0.08 kg/MT to about 0.16 kg/MT on an active basis of selected from the group consisting of sulfonated linear alcohol ethoxylates; and wherein the Kraft pulp is treated with the composition prior to an oxygen delignification process.

In another aspect, the current method relates to producing a high yield Kraft pulp by providing a Kraft pulp having a kappa number of at least about 30 and can be at least about 23 and may be at least about 20 for hardwood pulps, or kappa numbers of at least about 40, can be at least about 33, and may be at least about 30 for softwood pulps. The provided pulp is treated with a composition comprising: a) an organic amine phosphonate (DTMP); and b); a polyacrylate polymer, such as poly-alpha-hydroxyacrylate (PHAS) (see below); and wherein the Kraft pulp is treated with the composition prior to an oxygen delignification process.

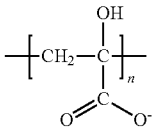

poly-alpha-hydroxyacrylate

In another aspect, the method of producing a high yield oxygen delignified Kraft pulp relates to providing a Kraft pulp having a kappa number of at least about 30 and can be at least about 23 and may be at least about 20 for hardwood pulps, or kappa numbers of at least about 40, can be at least about 33, and may be at least about 30 for softwood pulps; and treating the Kraft pulp with a composition comprising: a) an organic amine phosphonate in an amount of from about 0.17 kg/MT to about 0.57 kg/MT on active acid basis; and b) from about 0.43 kg/MT to about 1.43 kg/MT on an active basis of an poly-alpha-hydroxyacrylate (PHAS); and wherein the Kraft pulp is treated with the composition prior to an oxygen delignification process.

In yet other aspect, the method can include adding an optional magnesium to the Kraft pulp prior to, simultaneously with, or subsequent to adding the organic amine phosphonate/polyacrylate composition.

EXAMPLES

Example 1

Brownstock pulp treated with magnesium sulfate ($MgSO_4$) in the oxygen delignification stage results in a final pulp with a higher lignin content (as measured by kappa number as determined by TAPPI T236 om-13) than untreated pulp. This also occurs to a lesser extent with diethylenetriamine pentamethylene phosphonate salt (DTPMP) in the reaction, and to intermediate extents when the two are used together at varying ratios. Unexpectedly, the addition of a specific type of surfactant to the combined chelants in a formulated product results in a lower kappa number. Of particular importance are the anionic linear alcohols and ethoxylates in the form of sodium lauryl ether sulfate (SLES) and sodium lauryl ether phosphate (SLEP).

High lignin eucalyptus Kraft pulp (hereinafter identified by their kappa number, i.e. kappa 23) was delignified in a 2-stage process under "aggressive" conditions as shown in Table 1. The product was formulated with alternative surfactants and all were used in the delignification reaction at the same dosage on pulp.

TABLE 1

| Conditions | Starting kappa | % NaOH | Temperature, (° C.) | O2 Pressure, (psi) | Time, (minutes) |
|---|---|---|---|---|---|
| Stage I | 23 | 3.3 | 95 | 90 | 20 |
| Stage II | | no additional | 103 | 95 | 60 |

The oxygen delignification enhancement product was formulated without surfactant (B), without the phosphonated chelant (C), and without both (A). Alternative products were formulated (Table 3) with various surfactant types (D-J) as described in Table 2 below.

TABLE 2

| | Surfactant |
|---|---|
| A | none |
| B | none |
| C | Sodium lauryl ether sulfate (SLES) |
| D | Sodium lauryl ether sulfate (SLES) |
| E | Sodium lauryl ether phosphate (SLEP) |
| F | Sodium lauryl sulfate (SLS) |
| G | Sodium dodecyl benzene sulfonate (SDBS) |
| H | $C_{12}$-$C_{16}$ ethoxylated alcohol (3 ethylene oxide) |
| I | $C_{12}$-$C_{16}$ ethoxylated alcohol (22 ethylene oxide) |
| J | Silicone polyether (SPE) |

The product formulations and the resulting pulp kappa number and viscosity measurements after the oxygen delignification reaction are found in Table 3.

TABLE 3

| | $MgSO_4$, kg/MT | DTPMP, kg/MT | Surfactant, kg/MT | Final Kappa Number | Viscosity |
|---|---|---|---|---|---|
| Blank | 0 | 0 | 0 | 10.0 | 23.0 |
| A | 5 | 0 | 0 | 12.2 | 31.1 |
| B | 3.2 | 1.2 | 0 | 12.2 | 32.0 |
| C | 3.2 | 0 | 0.16 | 11.0 | 25.5 |
| D | 3.2 | 1.2 | 0.16 | 11.4 | 30.4 |
| E | 3.2 | 1.2 | 0.16 | 11.8 | 30.9 |
| F | 3.2 | 1.2 | 0.16 | 11.7 | 28.9 |
| G | 3.2 | 1.2 | 0.16 | 11.8 | 28.5 |
| H | 3.2 | 1.2 | 0.16 | 11.5 | 26.8 |
| I | 3.2 | 1.2 | 0.16 | 11.6 | 27.5 |
| J | 3.2 | 1.2 | 0.16 | 11.8 | 27.2 |

The results indicate that the addition of the SLES surfactant to the formulation allows a lower kappa number to be reached while maintaining a high viscosity. FIG. 1, illustrates a preferred lignin removal/kappa reduction is toward the left, and a preferred higher viscosity protection is toward the top. FIG. 1, shows that "Formulation D" containing the sodium lauryl ether sulfate surfactant gave the highest viscosity and lowest kappa number. The other ethoxylated anionic surfactant sodium lauryl ether phosphate (E) and the non-ethoxylated anionic sodium lauryl sulfate (F) provided a smaller improvement. The other surfactants did not provide this unexpected benefit.

Example 2

The final kappa number of the resulting pulp after the oxygen delignification stage is of paramount importance to the pulp maker. The cost of bleaching the pulp to the final target brightness is contingent on this incoming kappa number to the bleach plant. Inclusion of the surfactant improves performance of the oxygen delignification stage and decreases the cost of treatment through the entire bleaching line by lowering the kappa number. The amount of the specific preferred surfactant type (anionic linear ethoxylated alcohol) can be adjusted to affect the delignification while still protecting the pulp viscosity.

High lignin (kappa 23) eucalyptus Kraft pulp was delignified "aggressively" by 52% in 1-stage oxygen treatments at 103 degrees Celsius (° C.), 4% alkali, 90 pounds-per-square inch (psi) $O_2$ pressure for 60 minutes. The delignification enhancement product was formulated with the same levels of $MgSO_4$ and DTPMP, but containing varying levels of sodium lauryl ether sulfate (SLES) surfactant as defined in the Table 4 and dosed at the same level in all experiments.

Results shown in the last two columns indicate that increasing the surfactant dosage decreases the kappa number. The pulp viscosity (given in centipoise (cP) throughout the application) remains relatively un-affected at the lower doses (<0.03% on OD pulp) of surfactant.

TABLE 4

| $MgSO_4$, % on OD Pulp | DTPMP, % on OD Pulp | SLES, % on OD Pulp | Final Kappa Number | Final Viscosity, cP |
|---|---|---|---|---|
| 0.5 | 0.15 | 0 | 12.0 | 23.5 |
| 0.5 | 0.15 | 0.01 | 11.6 | 23.4 |
| 0.5 | 0.15 | 0.02 | 11.3 | 23.5 |
| 0.5 | 0.15 | 0.03 | 11.1 | 22.8 |
| 0.5 | 0.15 | 0.04 | 10.7 | 20.9 |
| 0.5 | 0.15 | 0.05 | 10.9 | 19.1 |

Example 3

The efficiency of oxygen delignification is dependent on the availability of $O_2$ to react with the fiber. This requires $O_2$ to diffuse from the gaseous phase into the water surrounding the fibers in the slurry, then from the aqueous phase into the fiber to react with lignin. Only a small fraction of the oxygen is dissolved in solution at any given time. The vast majority is in the gaseous phase in the form of small bubbles infused into the slurry by very aggressive mixing with $O_2$ in a medium consistency pump before delivery to the reactor tower. Poor mixing of oxygen with the pulp slurry will result in channeling of $O_2$ out of the mixture, and insufficient $O_2$ available to diffuse into solution for delignification when it is needed.

The oxygen delignification enhancement product is formulated with a surfactant that improves delignification, as indicated in Examples 1 and 2. This surfactant also enhances delignification in poorly mixed systems.

A eucalyptus Kraft pulp (kappa 20), was delignified with oxygen under "aggressive" conditions in one stage at 90° C., 4% NaOH on pulp, for 60 minutes at 90 psi. The surfactants were dosed at 0.5 kg/MT actives. A poorly mixed system was simulated by turning off the mixer at a fixed time interval for all experiments. The final kappa number of the "well mixed" reaction was 10 (50% delignification) as shown in the right column in Table 5. The effect of a "poorly mixed" system was an increase in kappa number to 15.1. The addition of various surfactants to the pulp slurry in a "poorly mixed" system is also shown in Table 5.

TABLE 5

| Sample | Mixing condition | Surfactant | Final Kappa Number |
|---|---|---|---|
| A | Well mixed | None | 10.0 |
| B | Poorly mixed | None | 15.1 |
| C | Poorly mixed | Sodium lauryl ether sulfate (SLES) | 14.0 |
| D | Poorly mixed | Sodium lauryl ether phosphate (SLEP) | 14.5 |
| E | Poorly mixed | Sodium lauryl sulfate (SLS) | 15.7 |
| F | Poorly mixed | Sodium dodecyl benzene sulfonate (SDBS) | 15.8 |
| G | Poorly mixed | C12-C16 ethoxylated alcohol (3 EO) | 15.1 |
| H | Poorly mixed | C12-C16 ethoxylated alcohol (22 EO) | 14.7 |
| I | Poorly mixed | Silicone polyether (SPE) | 15.3 |

Figure 2:
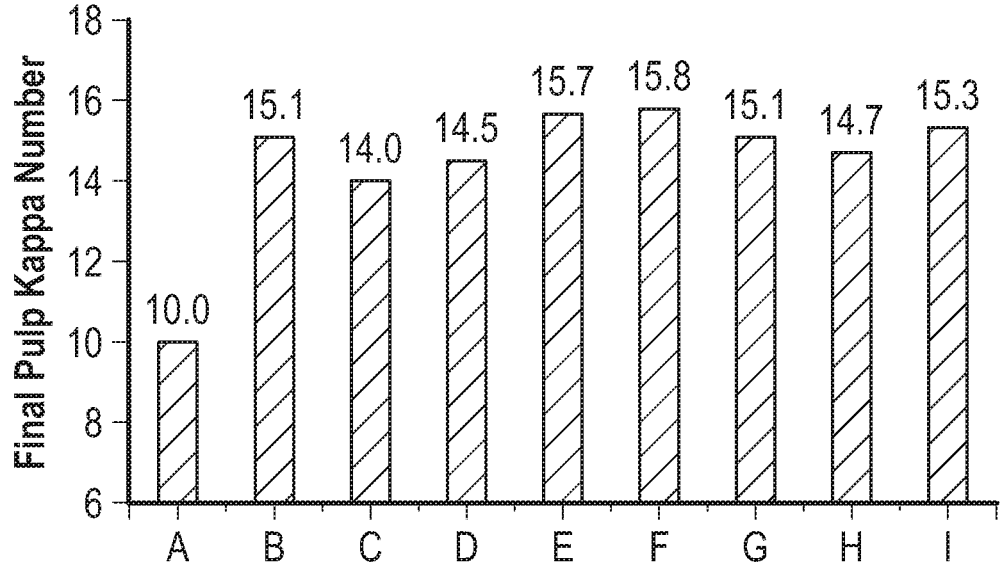
FIG. 2, shows kappa numbers under poor mixing conditions of various surfactants and no surfactant.

The addition of SLES (see sample C) to the slurry resulted in enhanced delignification of the slurry, as indicated by a larger decrease in kappa number under poor mixing conditions compared with other surfactants and to no surfactant (See FIG. 2).

Example 4

An important benefit of the oxygen delignification enhancement product is that higher kappa number pulp can be used, and that this pulp can be produced with higher yield than conventional lower kappa number pulp. The higher kappa number pulp must be delignified more aggressively to reach the same target kappa number where conventional pulp enters the bleach plant. More "aggressive" oxygen delignification requires higher alkali concentration to be used, higher temperature, longer retention times, or various combinations of these.

Higher lignin (kappa 23) eucalyptus Kraft pulp was delignified to a final kappa of 10 in 1-stage oxygen delignification reactions under two different sets of aggressive conditions of alkali and temperature. These conditions and the conditions of a "conventional" reaction are defined in Table 6.

TABLE 6

| Conditions | Starting Kappa Number | % NaOH on OD Pulp | Temperature, □ C. |
|---|---|---|---|
| Aggressive alkali | 23 | 5.1 | 103 |
| Aggressive temperature | 23 | 3.8 | 110 |
| Conventional | 16 | 2.2 | 103 |

The oxygen delignification enhancement product consisted of the components and amounts defined in Table 7.

TABLE 7

| $MgSO_4$, % on OD Pulp | DTPMP, % on OD Pulp | SLES, % on OD Pulp |
|---|---|---|
| 0.40 | 0.15 | 0.016 |

The product enhanced delignification by protecting the pulp viscosity from degradation under all scenarios compared with no treatment, or treatment with magnesium sulfate. The data in Table 8, summarize the effect on high kappa 23 pulp, and compares it to the effect of a conventional oxygen delignification stage on a low kappa 16 pulp.

TABLE 8

| Conditions | Final Pulp Viscosity, cP | | |
|---|---|---|---|
| | No treatment | 10 kg/MT $MgSO_4$ | 5.5 kg/MT Product |
| Aggressive alkali | 12.4 | 12.6 | 17.7 |
| Aggressive temp | 12.5 | 15.3 | 18.1 |
| Conventional | 27.5 | 30.5 | 32.3 |

Oxygen delignification is used almost exclusively on chemical pulps that will be further bleached to high brightness. The additional bleaching stages offer further opportunities for the pulp viscosity to be degraded, so the viscosity gains made using the oxygen delignification enhancement product must not be lost in bleaching. This was demonstrated by using the same pulps from Example 4, to which a $D_{HT}E_PD_1$ bleaching sequence was performed giving a pulp of 85 TAPPI brightness, wherein $D_{HT}$ is a hot 90° C. chlorine dioxide delignification stage; $E_P$ is a peroxide reinforced extraction stage; and $D_1$ is a chlorine dioxide brightening stage.

The results shown in Table 9, indicate that the use of the enhanced delignification formulation in the previous oxygen delignification stage resulted in higher strength fibers reported as breaking length (as determined from TAPPI T 231 cm-07 Zero-span breaking strength of pulp), which carried all the way through the described bleaching sequence.

TABLE 9

| Conditions | Bleached Zero-Span Fiber Tensile Breaking Length, km | | |
|---|---|---|---|
| | No treatment | 10 kg/MT $MgSO_4$ | 5.5 kg/MT Product |
| Aggressive alkali | 11.0 | 11.9 | 12.7 |
| Aggressive temp | 10.5 | 11.5 | 12.2 |
| Conventional | 12.7 | 13.2 | 13.4 |

Example 5

The oxygen delignification reaction can be made more selective if conducted in two stages, and many pulp mills operate such systems to benefit from this. In general, the pulp viscosity is degraded more if the pulp is treated in 1-stage as compared with treatment in a 2-stage system when delignified to the same final kappa. The 2-stage system may allow the pulp to be first treated at higher pH, higher oxygen pressure and lower temperature for a shorter time period, after which it may be treated in a second stage at lower pressure, lower pH, and higher temperature for a longer time. This favors the kinetics of lignin removal over that of pulp viscosity degradation.

Higher lignin (kappa 23) eucalyptus Kraft pulp was delignified to a kappa of 10 in a 1-stage and a 2-stage oxygen delignification process under aggressive conditions. This was compared with the mild single stage oxygen delignification of conventional eucalyptus Kraft pulp with lower starting kappa 16. The conditions are defined in Table 10.

TABLE 10

| Conditions | Starting Kappa Number | % NaOH | Temperature, □ C. | $O_2$ Pressure, psi | Time, min |
|---|---|---|---|---|---|
| Conventional | 16 | 1.85 | 103 | 90 | 60 |
| Aggressive 1-Stage | 23 | 4 | 103 | 90 | 60 |
| Aggressive 2-Stage: | 23 | | | | |
| Stage I | | 4 | 88 | 90 | 25 |
| Stage II | | no additional | 103 | 45 | 60 |

The oxygen delignification enhancement product as defined in Example 4, was applied at the same dosage 5.5 kg/MT pulp in all treatments. The experimental data in Table 11 indicates that the product protects the pulp viscosity in delignification using higher alkalinity over 2-stages superior to the protection offered in a 1-stage reaction. This process change from 1-stage to 2-stages does not replace the benefit provided by the oxygen delignification enhancement product, but instead there was a synergy in which both increased delignification and viscosity.

TABLE 11

| Conditions | Pulp Viscosity, cP | | |
|---|---|---|---|
| | No treatment | 10 kg/MT $MgSO_4$ | 5.5 kg/MT Product |
| Conventional | 27.5 | 30 | 36 |
| Aggressive 1-Stage | 14.2 | 15.5 | 20.9 |
| Aggressive 2-Stage | 15.3 | 16.4 | 21.5 |

Example 6

Several aminophosphonate chelants can be used in the formulation to provide benefits that enhance the oxygen delignification reaction by protecting pulp viscosity. The chelants described in Table 12, were formulated and applied as a pH neutral solution in which the phosphonate groups are typically substituted with sodium cations. They were measured and added into the formulation in the amount equivalent to the weight as active acid (see Table 12).

TABLE 12

| | Acronym | Compound |
|---|---|---|
| A | DTPMP 1* | Diethylenetriamine pentamethylene phosphonate |
| B | DTPMP 2 | Diethylenetriamine pentamethylene phosphonate |
| C | DTPMP 3 | Diethylenetriamine pentamethylene phosphonate |
| D | DTPMP 4 | Diethylenetriamine pentamethylene phosphonate |
| E | PIPPA | Polyisopropenylphosphonate |
| F | PAPEMP | Polyamino polyether methylene phosphonate |
| G | BHMPTMP | (Bis)hexamethylenetriamine pentamethylene phosphonate |
| H | HEDP | 1-Hydroxyethylidene-1, 1-Diphosphonate (Etidronate) |
| I | ATMP | Aminotrismethylene phosphonate |

*Phosphonates A-D are different commercial grades of DTPMP available from Zschimmer & Schwarz, Milledgeville, GA marketed under the trade name CUBLEN ™.

Higher lignin eucalyptus Kraft pulp (kappa 21), was delignified to a kappa of 9 in a 1-stage oxygen delignification under aggressive alkali conditions. This was for comparison with the mild alkali single stage oxygen delignification of lower starting kappa number pulp (K16) conventional eucalyptus Kraft pulp to a final kappa number of 10. The conditions are shown in Table 13.

TABLE 13

| Conditions | Starting Kappa Number | % NaOH | Temperature, □ C. | $O_2$ Pressure, psi | Time, min |
|---|---|---|---|---|---|
| Conventional mild | 16 | 1.85 | 103 | 90 | 60 |
| Aggressive 1-Stage | 21 | 4 | 103 | 90 | 60 |

The oxygen delignification enhancement product was formulated and applied to pulp experiments according to Table 14.

TABLE 14

| Phosphonate | $MgSO_4$, kg/MT | Phosphonate, kg/MT | SLES, kg/MT | Final Kappa Number | Final Viscosity cP |
|---|---|---|---|---|---|
| Blank | 0 | 0 | 0 | 8.6 | 14.6 |
| No Phosphonate | 3.2 | 0 | 0.16 | 8.6 | 16.7 |
| Formulation A | 3.2 | 1.2 | 0.16 | 8.8 | 19.9 |
| Formulation B | 3.2 | 1.2 | 0.16 | 8.6 | 19.7 |
| Formulation C | 3.2 | 1.2 | 0.16 | 9.4 | 21.8 |
| Formulation D | 3.2 | 1.2 | 0.16 | 9.0 | 20.3 |
| Formulation E | 3.2 | 1.2 | 0.16 | 8.6 | 17.6 |
| Formulation F | 3.2 | 1.2 | 0.16 | 8.6 | 17.6 |
| Formulation G | 3.2 | 1.2 | 0.16 | 8.7 | 18.3 |
| Formulation H | 3.2 | 1.2 | 0.16 | 9.2 | 20.0 |
| Formulation I | 3.2 | 1.2 | 0.16 | 8.8 | 16.9 |

Figure 3:
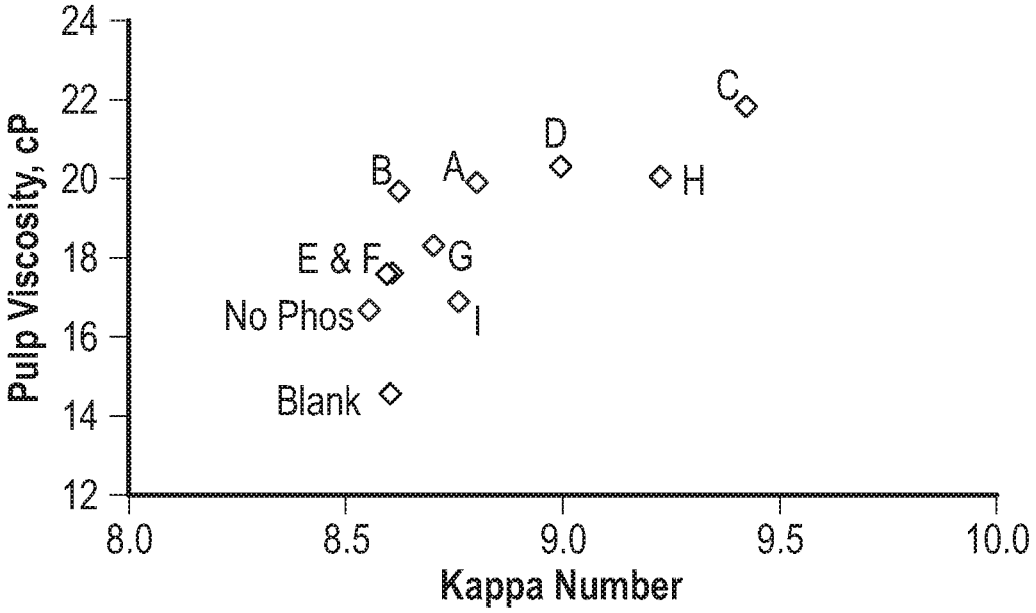
FIG. 3, shows pulp viscosities of treated and untreated pulps at various kappa numbers.

The conventional pulp reached a final kappa of 10, with a viscosity of 27.5 cP. The aggressively delignified kappa 21 pulp reached a lower final kappa of 8.6-9.4 (average 9.0), varying with phosphonate type as shown in Table 14. The highest delignification selectivity was provided by DTPMP "Formulations A-D", with "Formulation B" having a 35% increase at equivalent kappa to the blank. The graphical representation in FIG. 3, indicates the improved viscosity (upward on the y-axis) at the desired lower kappa number (leftward on the x-axis). The phosphonated chelants PIPPA (Formulation E), PAPEMP (Formulation F), BHMPTMP (Formulation G), HEDP (Formulation H) and ATMP (Formulation I) also increased viscosity to varying degrees greater than the formulation without the phosphonate (See FIG. 3).

Example 7

There is a need for an oxygen delignification enhancement product that allows the reduction of lignin content (kappa number) while protecting the pulp strength (viscosity). Formulations that contain phosphonate chelants and magnesium salts may be improved upon in both respects. Polymeric compounds may be added to the formulation to enhance the performance of the chelant. Examples of typical polymers applied in this way can include polyacrylates and co-polymers of acrylic and maleic acid, such as, Solenis LLC products Infinity® SL4393/Polystabil® 922, Infinity® SL4335, and Infinity® SL4342/Aquatreat® AR410.

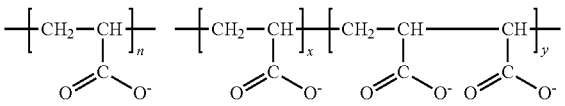

polyacrylate polyacrylate-co-maleate

The protection of pulp viscosity by a phosphonate chelant such as diethylenetriamine pentamethylene phosphonate (DTPMP) can be augmented by the addition of these polymers. The anionic charged groups may also directly interact (bind) with transition metal ions to some extent. This interaction may be enhanced by various functional groups on the polymer backbone, specifically hydroxyl groups attached to the alpha-carbon in the polyhydroxyacrylic acid polymer (PHAS) shown below. An unexpected synergistic enhancement of pulp viscosity protection by DTPMP is seen with formulations containing PHAS, greater than that seen with other polyacrylate polymers

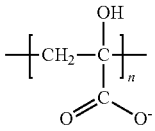

poly-alpha-hydroxyacrylate

Because of pulp processing concerns, there is a need for oxygen delignification enhancement formulations that can reduce or eliminate non-process elements (NPIs) such as inorganic mineral salts like magnesium. These salts are recirculated in the recovery cycle due to the fact that they are not removed by combustion and increase in concentration over time. Increasing NPIs can contribute to a decrease in pulping efficiency, interfere with some process chemicals, complicate pulping chemical regeneration cycles, and contribute to equipment scaling problems. Formulations containing magnesium sulfate also require large dosages to be effective, typically 5-10 kg Epsom salt/metric ton of pulp. This is a logistical challenge, as modern mega-mills can produce over 5,000 MT of pulp per day, requiring perhaps 50 metric tons of Epsom salt per day. Through extensive studies, it was found that a composition comprising an organic amine phosphonate and a polymeric PHAS allows the complete removal of magnesium salts. The polymeric formulation also allows for the delignification reaction to reach lower kappa number than when using $MgSO_4$ containing formulations under similar conditions.

A high kappa eucalyptus Kraft pulp (K20) was delignified by greater than 50% in an aggressive 1-stage oxygen delignification process using the conditions found in Table 15.

TABLE 15

| Conditions | Starting Kappa Number | NaOH % on OD Pulp | Temp, □ C. | $O_2$, psi | Time, minutes |
|---|---|---|---|---|---|
| Aggressive 1-Stage | 20 | 4 | 103 | 90 | 60 |

The dosage of phosphonate was 2.5 kg/MT based on pulp and the polymer dosage was 2.5 kg/MT as listed in Table 16. The polymer was used in place of any $MgSO_4$. These formulations were compared with a formulation containing a typical mill dosage of magnesium sulfate, and also with no treatment additive as shown in Table 16.

TABLE 16

| Component | A | B | C | D | E | Blank |
|---|---|---|---|---|---|---|
| Diethylenetriamine pentamethylene phosphonate (DTPMP) | 2.5* | 2.5 | 2.5 | 2.5 | 0 | 0 |

TABLE 16-continued

| Component | A | B | C | D | E | Blank |
|---|---|---|---|---|---|---|
| Poly-alpha-hydroxy acrylate salt (PHAS) | 0 | 2.5 | 0 | 0 | 0 | 0 |
| Acrylate-maleate copolymer (AA/MA) | 0 | 0 | 2.5 | 0 | 0 | 0 |
| Acrylate polymer (AA) | 0 | 0 | 0 | 2.5 | 0 | 0 |
| Magnesium sulfate | 0 | 0 | 0 | 0 | 4 | 0 |

*kg/MT pulp in formulation

The resulting pulp kappa number and viscosity can be seen in Table 17.

TABLE 17

| Formulation | Final Kappa | Final Viscosity |
|---|---|---|
| A | 9.9 | 23.1 |
| B | 8.9 | 21.3 |
| C | 9.5 | 22.7 |
| D | 9.2 | 20.6 |
| E | 9.4 | 18.9 |
| Blank | 8.5 | 15.1 |

Figure 4:
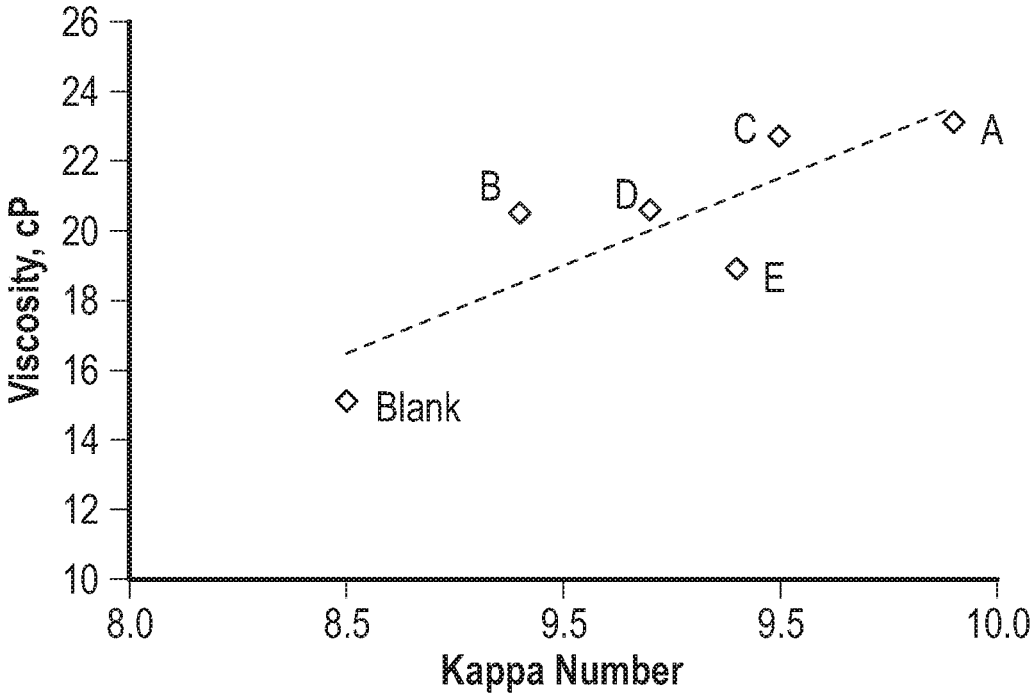
FIG. 4, shows pulp viscosities of treated and untreated pulps at various kappa numbers.

Treatment with only DTPMP showed some cellulose protection but does not allow the lower kappa number to be reached, while addition of the polymers allowed a lower kappa (lignin content) to be achieved while still protecting the cellulose to a varying extent as seen in FIG. 4. Formulation D and Formulation C allowed a reduced kappa number compared with treatment with only DTPMP (Formulation A), but the enhanced performance was most pronounced for the poly-alpha-hydroxy acrylate salt (PHAS) polymer (Formulation B), which gave a beneficial higher viscosity (upward on the y-axis) as kappa number was reduced (leftward on the x-axis) (See FIG. 4).

Example 8

There is a need for improved environmental performance of pulp mills by reducing the amounts of phosphorus and nitrogen containing chemicals used in pulping and bleaching operations.

The eucalyptus pulp used in Example 7, kappa (K20), was delignified with oxygen under slightly milder conditions as seen in Table 18, afford approximately 50% delignification.

TABLE 18

| Conditions | Starting Kappa | NaOH % on OD Pulp | Temp, □ C. | $O_2$, psi | Time, min |
|---|---|---|---|---|---|
| Aggressive 1-Stage | 20 | 3.75 | 103 | 90 | 60 |

The dosage of phosphonate was reduced to 1.5 kg/MT from the previous 2.5 kg/MT (Example 7), a 40% decrease. The polymer dosage was maintained at 2.5 kg/MT. The combinations of DTPMP and polymers were compared with treatment with DTPMP only (A), and treatment with DTPMP combined with magnesium sulfate (E) as shown in Table 19.

TABLE 19

| Component | A | B | C | D | E | Blank |
|---|---|---|---|---|---|---|
| Diethylenetriamine pentamethylene phosphonate (DTPMP) | 1.5* | 1.5 | 1.5 | 1.5 | 1.5 | 0 |
| Poly-alpha-hydroxy acrylate (PHAS) | 0 | 2.5 | 0 | 0 | 0 | 0 |
| Acrylate-maleate copolymer (AA/MA) | 0 | 0 | 2.5 | 0 | 0 | 0 |
| Acrylate polymer (AA) | 0 | 0 | 0 | 2.5 | 0 | 0 |
| Magnesium sulfate | 0 | 0 | 0 | 0 | 4 | 0 |

*kg/MT pulp in formulation

With the lower phosphonate dosage, the polymers provided a synergistic protection of the cellulose when the same approximate kappa was obtained. The PHAS polymer (Formulation B) provided the greatest delignification enhancement as shown in Table 20.

TABLE 20

| Formulation | Final Kappa Number | Final Viscosity (cP) |
|---|---|---|
| A | 9.9 | 20.0 |
| B | 9.7 | 23.8 |
| C | 9.7 | 22.6 |
| D | 9.3 | 20.4 |
| E | 9.7 | 20.7 |
| Blank | 9.0 | 15.4 |

Example 9

The previous example demonstrated that there is an unexpected benefit from the combination of phosphonate chelant and acrylate polymers for the enhancement of oxygen delignification and pulp viscosity protection. These results from above were investigated further with the PHAS polymer (poly-alpha-hydroxyacrylate salt) under a milder delignification regime. Kappa K20 eucalyptus pulp was delignified in 1-stage using oxygen under the following conditions:

TABLE 21

| Conditions | Starting Kappa | NaOH % on OD Pulp | Temp, □ C. | $O_2$, psi | Time, min |
|---|---|---|---|---|---|
| Aggressive 1-Stage | 20 | 3.75 | 103 | 90 | 60 |

The pulp viscosity was measured in response to decreased DTPMP dosage while the PHAS component of the formulation was held constant. This was compared with treatments with DTPMP only, PHAS only, magnesium sulfate only, as well as an untreated sample. The formulations for these experiments are shown in Table 22.

TABLE 22

| Component | A | B | C | D | E | F | Blank |
|---|---|---|---|---|---|---|---|
| Diethylenetriamine pentamethylene phosphonate (DTPMP) | 1.5* | 1.0 | 0.5 | 0 | 1.5 | 0 | 0 |
| Poly-alpha-hydroxy acrylate (PHAS) | 2.5 | 2.5 | 2.5 | 2.5 | 0 | 0 | 0 |
| Magnesium sulfate | 0 | 0 | 0 | 0 | 0 | 4 | 0 |

*kg/MT pulp in formulation

The results are shown in Table 23.

TABLE 23

| Formulation | Final Kappa Number | Final Viscosity (cP) |
|---|---|---|
| A | 10 | 25.5 |
| B | 9.3 | 24.9 |
| C | 9.8 | 23.8 |
| D | 9.5 | 19.5 |
| E | 9.9 | 20.6 |
| F | 9.7 | 20.7 |
| Blank | 9 | 15.4 |

The results indicate that the dosage of the phosphonate could be reduced another 150% when using 0.5 kg/MT with 2.5 kg/MT of the PHAS (Formulation C) while still affording sufficient cellulose protection. The use of PHAS also allowed the complete elimination of the magnesium sulfate component in the formulations.

The lower dosage of phosphonate allowed by the synergistic effect of the PHAS polymer was also tested under more aggressive conditions as shown in Table 24. Higher kappa eucalyptus Kraft pulp K23 was delignified by 57% in 1-stage oxygen delignification using the conditions.

TABLE 24

| Conditions | Starting Kappa Number | NaOH % on OD Pulp | Temp (□ C.) | $O_2$ (psi) | Time, (minutes) |
|---|---|---|---|---|---|
| Aggressive 1-Stage | 23 | 4.0 | 103 | 90 | 60 |

The results in Table 25 indicate there is a synergistic affect when the Formulation contains PHAS with a DTPMP chelant in the enhancement of delignification under aggressive alkali and temperature conditions.

TABLE 25

| Formulation | Final Kappa Number | Final Viscosity (cP) |
|---|---|---|
| A | 11.2 | 23.4 |
| B | 10.9 | 22.2 |
| C | 9.8 | 21.5 |
| D | 9.2 | 19 |
| E | 9.9 | 18.6 |
| F | 9.4 | 18.9 |
| Blank | 9.3 | 14.2 |

Example 10

The previous example demonstrated that the combination of phosphonate chelant plus acrylate-based polymers including poly-alpha-hydroxyacrylate salt (PHAS) is robust enough to offer cellulose protection in aggressive oxygen delignification reactions at low phosphonate levels, even in the absence of magnesium sulfate $MgSO_4$. This enhancement was investigated further in an aggressive 2-stage oxygen delignification reaction.

High kappa number eucalyptus Kraft pulp (K23) was aggressively delignified with oxygen in a 2-stage process under the following conditions.

TABLE 27

| Conditions | Starting Kappa | % NaOH | Temp, □ C. | $O_2$, psi | Time, min |
|---|---|---|---|---|---|
| Stage I | 23 | 3.75 | 88 | 90 | 25 |
| Stage II | | no additional | 103 | 45 | 60 |

The additive components were formulated together using a combination of DTPMP chelant and PHAS polymer (ratio 3:5) according to Table 28.

TABLE 28

| Component | A | B | C | D | E | F | G | Blank |
|---|---|---|---|---|---|---|---|---|
| Diethylene-triamine pentamethylene phosphonate (DTPMP) | 1.5* | 1.0 | 0.5 | 0 | 1.5 | 0 | 1.5 | 0 |
| Poly-alpha-hydroxy acrylate PHAS) | 2.5 | 1.67 | 0.83 | 2.5 | 0 | 0 | 0 | 0 |
| Magnesium sulfate | 0 | 0 | 0 | 0 | 0 | 5 | 4 | 0 |
| Total combined | 4.00 | 2.67 | 1.33 | 2.50 | 1.50 | 5.00 | 5.50 | 0.00 |

*kg/MT pulp in formulation

The combined product offered the same synergistic protection of pulp viscosity in the 2-stage reaction as in the 1-stage reaction by not allowing the lowering of viscosity. There was also demonstrated a clear dose-response as shown in Table 29. The lowest level of the combined product (Formulation C) was 1.33 kg/MT pulp, and afforded a 48% higher viscosity 21.3 cP compared with no treatment at 14.4 cP.

TABLE 29

| Formulation | Final Kappa Number | Final Viscosity, (cP) |
|---|---|---|
| A | 10.0 | 25.2 |
| B | 10.2 | 24.9 |
| C | 10.0 | 21.3 |
| D | 10.2 | 20.0 |
| E | 10.3 | 21.7 |
| F | 9.8 | 19.0 |
| G | 10.5 | 20.9 |
| Blank | 9.2 | 14.4 |

The same delignification enhancement was observed when an even higher kappa number (K25) pulp was used under slightly more aggressive or harsher conditions in a 2-stage oxygen delignification process shown in Table 30.

TABLE 30

| Conditions | Starting Kappa | % NaOH | Temp (□ C.) | $O_2$ (psi) | Time (min) |
|---|---|---|---|---|---|
| Stage I | 25 | 4.00 | 88 | 90 | 25 |
| Stage II | | no additional | 103 | 45 | 60 |

The additive components were formulated together using a combination of DTPMP chelant and PHAS polymer (ratio 3:5) similar to the last example, and according to Table 31.

TABLE 31

| Component | A | B | C | D | E | F | Blank |
|---|---|---|---|---|---|---|---|
| Diethylenetriamine pentamethylene phosphonate (DTPMP) | 1.5* | 0.73 | 0.60 | 0.48 | 0 | 0 | 0 |
| Poly-alpha-hydroxy acrylate (PHAS) | 2.5 | 1.21 | 1.01 | 0.81 | 2.5 | 0 | 0 |
| Magnesium sulfate | 0 | 0 | 0 | 0 | 0 | 5 | 0 |
| Total combined | 4.00 | 1.94 | 1.61 | 1.29 | 2.50 | 5.00 | 0.00 |

*kg/MT pulp in formulation

The results indicate a similar dose-response (Table 32) for the combination of the components on increased viscosity for pulp having a starting kappa number of 25 (K25), as compared with the lower kappa number (K23) starting pulp.

TABLE 32

| Formulation | Final Kappa Number | Final Viscosity (cP) |
|---|---|---|
| A | 11.9 | 22.0 |
| B | 11.5 | 21.4 |
| C | 11.1 | 21.2 |
| D | 11.2 | 20.9 |
| E | 10.2 | 20.1 |
| F | 9.8 | 15.7 |
| Blank | 9.9 | 13.9 |

Example 11

The combination of phosphonate chelant plus acrylate-based polymers including polyhydroxyacrylate salt (PHAS) is also beneficial for aggressive 2-stage oxygen delignification performed with higher temperatures and shorter retention times. Higher kappa eucalyptus pulp (K23) was treated in a shortened more aggressive 2-stage oxygen delignification at higher temperatures as described in Table 33. The first stage was shortened to only 5 minutes, while the final stage was 60 minutes, 50 minutes, or 40 minutes long.

TABLE 33

| Conditions | Starting Kappa Number | % NaOH | Temp (□ C.) | $O_2$ (psi) | Time (minutes) |
|---|---|---|---|---|---|
| Stage I | 23 | 3.30 | 95 | 100 | 5 |
| Stage II | | no additional | 106 | 90 | 60, 50, 40 |

The combination of DTPMP and PHAS in the ratio of 3:5 was dosed at different levels (Formulation B and C). This was compared with untreated samples, samples treated with magnesium sulfate (Formulation A), and samples with magnesium sulfate and DTPMP (Formulation D) as shown in Table 34.

TABLE 34

| Component | Blank | A | B | C | D |
|---|---|---|---|---|---|
| Diethylenetriamine pentamethylene phosphonate (DTPMP) | 0 | 0 | 0.37 | 0.32 | 1.5 |
| Poly-alpha-hydroxy acrylate (PHAS) | 0 | 0 | 0.92 | 0.704 | 0 |
| Magnesium sulfate | 0 | 5 | 0 | 0 | 4 |
| Total combined, kg/MT | 0.00 | 5.00 | 1.29 | 1.03 | 5.50 |

The results from all experiments are shown in Table 35. The table headings 5 plus 60, 5 plus 50, and 5 plus 40 indicate reaction times of 5 min in the first stage and 60, 50, or 40 minutes in the second stage.

TABLE 35

Results showing Final Kappa and Viscosity Numbers

| Sample | 5 plus 60 | 5 plus 50 | 5 plus 40 |
|---|---|---|---|
| | Final Kappa Number | | |
| Blank | 10 | 10.5 | 11.2 |
| Formula A | 10.3 | 10.9 | 11.5 |
| Formula B | 10 | 10.5 | 11.4 |
| Formula C | 10 | 10.5 | 11.2 |
| Formula D | 10.5 | 10.7 | 11.6 |
| | Final Pulp Viscosity (cP) | | |
| Blank | 15.2 | 15.4 | 15.9 |
| Formula A | 19 | 20.3 | 21.2 |
| Formula B | 18.3 | 19.6 | 21.8 |
| Formula C | 18.3 | 18.8 | 20.6 |
| Formula D | 20.4 | 20.5 | 22.4 |

Figure 5:
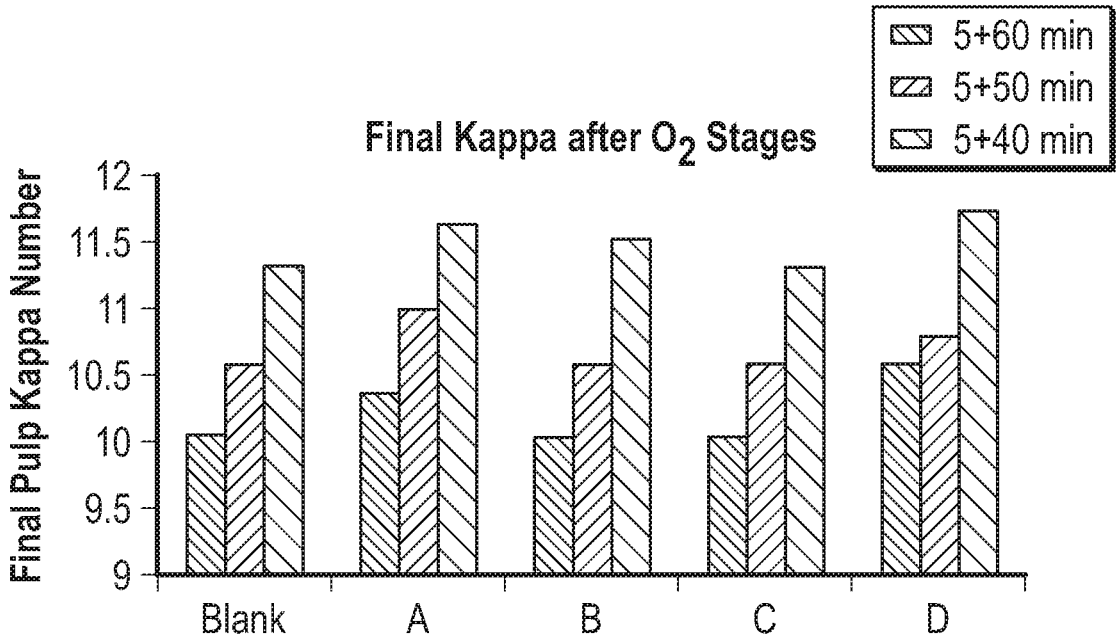
FIG. 5, shows final kappa numbers of treated and untreated pulps.

The resulting kappa numbers from these aggressive treatments are shown graphically in FIG. 5, which shows there is a clear trend for the shorter retention times to impede delignification to some extent (higher kappa numbers), but not equally among all treatments. Results indicate that the current formulations when used under industrially relevant constraints can significantly reduce the retention time needed to reduce the kappa number of the pulp.

Figure 6:
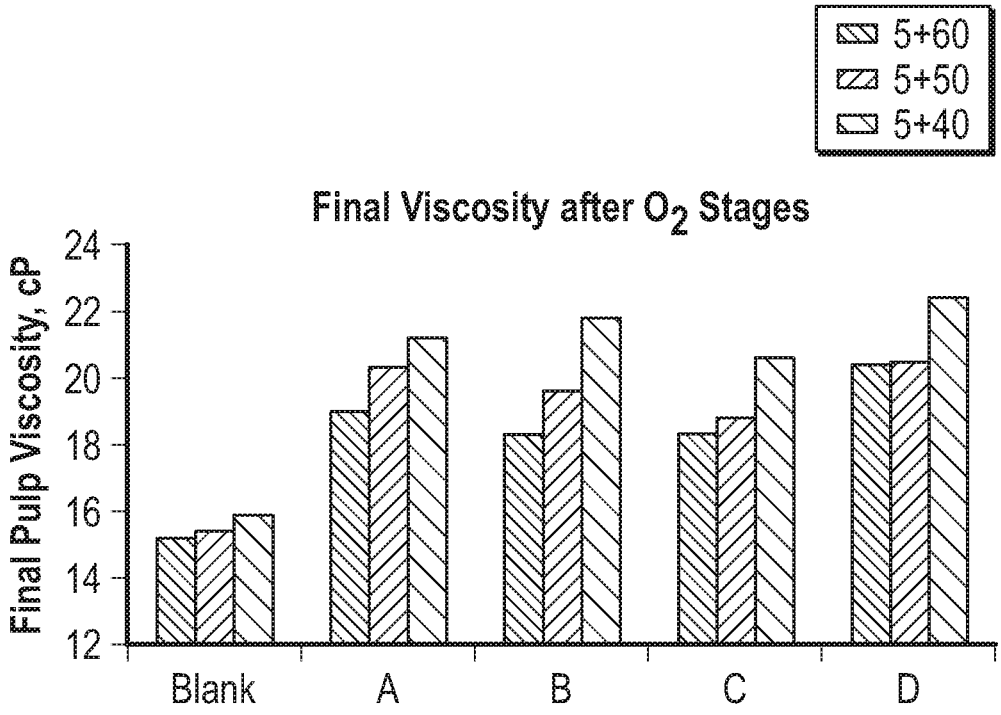
FIG. 6, shows final pulp viscosity of treated and untreated pulps.

The results shown in FIG. 5, indicated that when the time for the delignification reaction is shortened substantially, the final kappa attained is higher for pulp treated with magnesium sulfate $MgSO_4$ relative to untreated pulp. However, treatment with the 2-component formulation, i.e. DTPMP and PHAS, affords pulp with the same final kappa as untreated pulp, but with a higher viscosity as shown in FIG. 6. These results indicate that effective delignification can be realized with good viscosity protection even under reduced retention times.

The DTPMP and PHAS formulation also offers the added benefit of a large reduction in the dosage of product required for pulp viscosity protection (approximately 4 times lower) versus magnesium sulfate containing formulations. The 2-component formulation protects the pulp viscosity up to 27% higher than no treatment.

Example 12

There are many combinations of temperatures and retention times in 2-stage oxygen delignification that may be beneficial to the pulp mill. Higher temperatures and shorter retention times generally can be used to increase the production rate, but the combination can reduce both delignification efficiency and pulp viscosity. The addition of phosphonate chelant plus acrylate-based polymers including poly-alpha-hydroxyacrylate salt (PHAS) are beneficial for aggressive 2-stage oxygen delignification performed with higher temperatures and shorter retention times as was shown in Example 11. There are numerous combinations of temperatures and retention times in a 2-stage delignification process, in addition to alkali usage levels used, to reach the lowest kappa number while minimizing viscosity loss. Several of these combinations were used in experiments as shown in Table 36.

TABLE 36

| | Delignification Conditions | | | |
|---|---|---|---|---|
| | 1 | 2 | 3 | 4 |
| Time in 2-stages, minutes | 10 plus 50 | 20 plus 70 | 20 plus 70 | 20 plus 70 |
| Temperatures, C. ° | 95 plus 100 | 88 plus 103 | 92 plus 103 | 102 plus 105 |
| NaOH, % on OD Pulp | 3.3 | 3.6 | 3.4 | 2.6 |

The delignification conditions 1-4 described in Table 36, above were each used with different chemical treatments labeled as Formulations A-D, as shown in Table 37.

TABLE 37

| Component | Blank | A | B | C | D |
|---|---|---|---|---|---|
| Diethylenetriamine pentamethylene phosphonate (DTPMP) | 0 | 0 | 0.32 | 0.48 | 1.18 |
| Poly-alpha-hydroxyacrylate (PHAS) | 0 | 0 | 0.704 | 0.81 | 0 |
| Magnesium sulfate | 0 | 5 | 0 | 0 | 3.15 |
| Total combined, kg/MT | 0.00 | 5.00 | 1.03 | 1.29 | 4.33 |

The final kappa number results are shown in Table 38.

TABLE 38

| Final Pulp Kappa Number | | | | |
|---|---|---|---|---|
| | Delignification Conditions | | | |
| | 1 | 2 | 3 | 4 |
| Blank | 10.9 | 9.8 | 9.5 | 10.6 |
| A | 10.6 | 9.9 | 9.7 | 10.8 |
| B | 10.8 | 10.3 | 10.0 | 10.7 |
| C | 11.0 | 10.2 | 10.0 | 10.8 |
| D | 11.0 | 10.8 | 10.9 | 11.4 |

Figure 7:
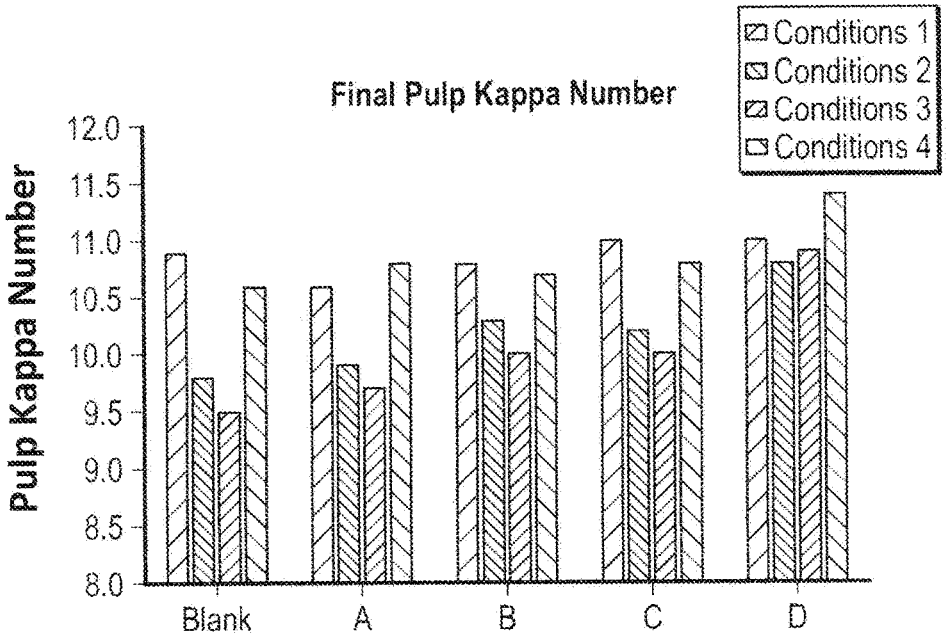
FIG. 7, shows final pulp kappa numbers of treated pulps under various reaction conditions.

The different delignification conditions had varying effects on the reaction efficiency, as shown in FIG. 7. The kappa number was higher when the reaction was limited by time (Condition 1) or alkali level (Condition 4). Combining higher temperatures with lower alkali levels allowed more extensive delignification (Condition 3 vs Condition 2). FIG. 7, shows that chemical treatments affected delignification differently within any particular set of reaction conditions. For example, "Formulation B" and "Formulation C" were better at enhancing delignification under conditions of hotter stage temperatures, longer retention times, and lower alkali addition rates.

The final pulp viscosity is shown in Table 39.

TABLE 39

| Final Pulp Viscosity, cP | | | | |
|---|---|---|---|---|
| | Delignification Conditions | | | |
| | 1 | 2 | 3 | 4 |
| Blank | 18.0 | 15.1 | 15.9 | 19.1 |
| A | 20.5 | 18.0 | 19.0 | 23.0 |
| B | 20.8 | 18.5 | 19.5 | 23.6 |
| C | 21.2 | 18.7 | 19.8 | 26.6 |
| D | 22.2 | 20.7 | 21.3 | 25.5 |

Figure 8:
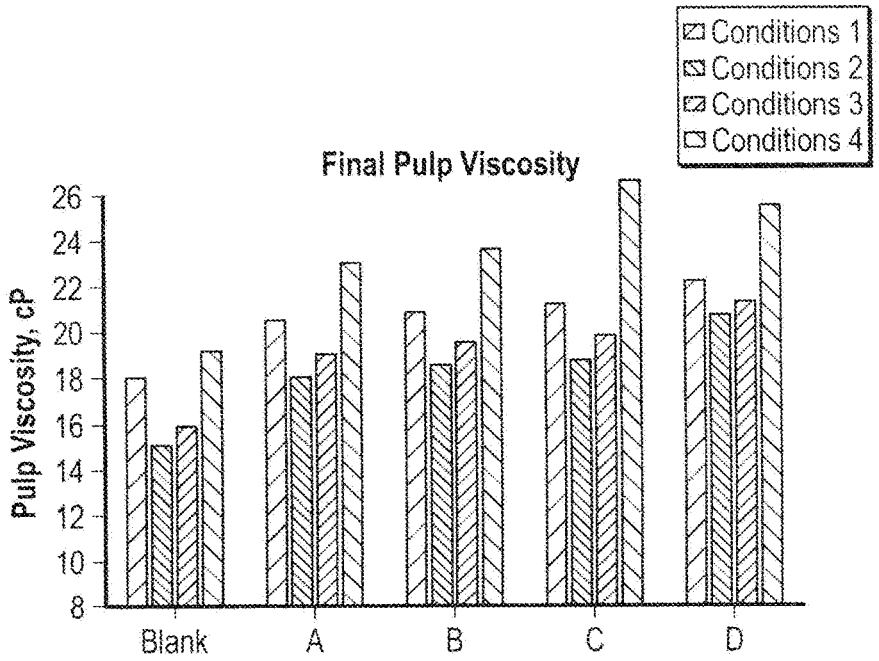
FIG. 8, shows final pulp viscosity of treated pulps under various reaction conditions.

The pulp viscosity was improved by the use of the various additives as shown graphically in FIG. 8. The different treatments responded in similar ways under the different conditions, and improved viscosity level over the blank can be attributed both to the additive chemistry and dosage levels. Depending on the delignification conditions, a specific type of treatment may provide a valuable benefit over others. For example, treatment "Formulation B" was sufficient to protect viscosity by an average of 22% over the blank at just 1 kg/MT treatment dosage and contains 0% magnesium sulfate (see FIG. 8). Additionally, treatment "Formulation B" and "Formulation C" afforded the best delignification and viscosity protection under conditions of hotter stage temperatures, longer retention times, and lower alkali addition rates.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A method of producing an oxygen delignified Kraft pulp comprising:

providing a Kraft pulp having an initial pulp viscosity and an initial kappa number of at least about 20 for hardwood pulps or kappa numbers of at least about 30 for softwood pulps;

treating the Kraft pulp with a composition comprising: a) an organic amine phosphonate; b) a magnesium salt; and c) one or more anionic linear alcohols and ethoxylates; wherein the organic amine phosphonate is selected from diethylenetriamine pentamethylene phosphonic acid (DTMP), aminotrismethylene phosphonate (ATMP), (Bis)hexamethylenetriamine pentamethylene phosphonic acid (BHMTPMP), polyamino polyether methylenephosphonate (PAPEMP) and combinations thereof; wherein the anionic linear alcohols and ethoxylates is selected from sodium lauryl ether sulfate (SLES), sodium lauryl ether phosphate (SLEP), sodium lauryl sulfate (SLS) and combinations thereof;

lowering the initial kappa number of the kraft pulp to a predetermined final kappa number, wherein the Kraft pulp is treated with the composition prior to a 2-stage oxygen delignification process; and wherein the final pulp viscosity remains higher when compared with an untreated oxygen delignified Kraft pulp.

2. The method according to claim 1, wherein the magnesium salt is selected from the group consisting of a magnesium divalent cation $Mg^{2+}$, magnesium sulfate, magnesium sulfate heptahydrate.

3. The method according to claim 1, wherein the temperature of the first stage of the 2-stage oxygen delignification process is from about 80 degrees Celsius (° C.) to about 100° C. and the temperature of the second stage is from about 90° C. to about 120° C.; and wherein the pressure of the first stage is from about 80 pounds per square inch (psi)

to about 120 psi $O_2$, and the pressure of the second stage is from about 25 psi to about 90 psi.

4. The method according to claim 1, wherein the Kraft pulp has a consistency of at least about 9% solids and an alkalinity of from about 2% to about 5% as equivalent NaOH on oven dry pulp.

5. The method according to claim 1, wherein the composition comprises: a) an organic amine phosphonate in an amount of from about 0.6 kg/MT to about 1.2 kg/MT by wt. of the total composition; b) magnesium salt $_{[M''H1]}$ in an amount of from about 0.1 kg/MT to about 3.2 kg/MT anhydrous basis; and c) from about 0.08 kg/MT to about 0.16 kg/MT by wt. of the total composition.

6. A method of producing an oxygen delignified Kraft pulp in a 2-stage delignification process comprising: providing a Kraft pulp having an initial kappa number of at least 20; and treating the Kraft pulp with a composition comprising: a) an organic amine phosphonate; and b) an anionic polyacrylate; wherein the organic amine phosphonate is selected from diethylenetriamine pentamethylene phosphonic acid (DTMP), aminotrismethylene phosphonate (ATMP), (Bis)hexamethylenetriamine pentamethylene phosphonic acid (BHMTPMP), polyamino polyether methylenephosphonate (PAPEMP) and combinations thereof; wherein the Kraft pulp is treated with the composition prior to the 2-stage oxygen delignification process; and wherein the initial kappa number of the pulp is lowered, and wherein the final pulp viscosity remains higher when compared with an untreated oxygen delignified Kraft pulp.

7. The method of claim 6, wherein the anionic polyacrylate is a poly-alpha-hydroxyacrylate salt (PHAS).

8. The method according to claim 6, further comprising adding a magnesium salt to the Kraft pulp.

9. The method of claim 8, wherein the magnesium salt is selected from the group consisting of a magnesium divalent cation $Mg^{2+}$, magnesium sulfate, and magnesium sulfate heptahydrate.

10. The method according to claim 6, wherein the temperature of the first stage of the 2-stage oxygen delignification process is from about 80 degrees Celsius (° C.) to about 100° C. and the temperature of the second stage is from about 90° C. to about 120° C.; and wherein the pressure of the first stage is from about 80 pounds per square inch (psi) to about 120 psi $O_2$, and the pressure of the second stage is from about 25 psi to about 90 psi.

11. The method according to claim 10, wherein the pressure of the first stage is from about 90 psi to 110 psi $O_2$ and the pressure of the second stage is from about 50 psi to about 90 psi $O_2$.

12. A method of producing a 2-stage oxygen delignified Kraft pulp comprising: providing a Kraft pulp having an initial pulp viscosity and an initial kappa number of at least about 20 for hardwood pulps or initial kappa numbers of at least about 30 for softwood pulps; treating the Kraft pulp with a composition comprising: a) an organic amine phosphonate in an amount of from about 0.17 kg/MT to about 0.57 kg/MT by wt. of the total composition; b) magnesium salt in an amount of from about 0 kg/MT to about 3.2 kg/MT anhydrous basis; and c) an anionic polyacrylate in an amount of from about 0.43 kg/MT to about 1.43 kg/MT by wt. of the total composition; wherein the organic amine phosphonate is selected from the group consisting of diethylenetriamine pentamethylene phosphonic acid (DTMP), aminotrismethylene phosphonate (ATMP), (Bis)hexamethylenetriamine pentamethylene phosphonic acid (BHMTPMP), polyamino polyether methylenephosphonate (PAPEMP) and combinations thereof; wherein the anionic linear alcohols and ethoxylates is selected from the group consisting of sodium lauryl ether sulfate (SLES), sodium lauryl ether phosphate (SLEP), sodium lauryl sulfate (SLS) and combinations thereof; wherein the Kraft pulp is treated with the composition prior to the 2-stage oxygen delignification process and wherein the initial kappa number of the Kraft pulp is lowered to a predetermined final kappa number, and wherein the final pulp viscosity remains higher when compared with an untreated oxygen delignified.

13. The method according to claim 12, wherein the anionic polyacrylate is a poly-alpha-hydroxyacrylate (PHAS).

14. The method according to claim 12, wherein the Kraft pulp has a kappa number of at least about 23.

* * * * *